US008667702B2

(12) United States Patent
Ediger et al.

(10) Patent No.: US 8,667,702 B2
(45) Date of Patent: Mar. 11, 2014

(54) DOMESTIC APPLIANCE WITH AN OPEN AIR DUCT

(75) Inventors: Rainer Ediger, Berlin (DE); Thomas Nawrot, Berlin (DE); Werner Nühse, Dallgow-Döberitz (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 841 days.

(21) Appl. No.: 12/627,038

(22) Filed: Nov. 30, 2009

(65) Prior Publication Data

US 2010/0155039 A1 Jun. 24, 2010

(30) Foreign Application Priority Data

Dec. 22, 2008 (DE) ..... 10 2008 055 088

(51) Int. Cl.
*F26B 3/04* (2006.01)

(52) U.S. Cl.
USPC ..... 34/60; 34/90; 34/595; 34/601; 34/606; 68/5 R; 68/18 C; 353/57; 353/61; 415/213.1; 165/58; 454/267; 454/359

(58) Field of Classification Search
USPC ..... 34/60, 90, 595, 600, 601, 606, 610; 353/57, 60, 61; 415/213.1; 165/59, 58, 165/61; 454/267, 359; 68/5 R, 18 C
See application file for complete search history.

(56) References Cited

U.S. PATENT DOCUMENTS

| | | | | | |
|---|---|---|---|---|---|
| 1,663,199 | A | * | 3/1928 | Hirschman | 454/363 |
| 2,201,229 | A | * | 5/1940 | Gross | 34/82 |
| 2,986,765 | A | * | 6/1961 | Ernolf et al. | 15/329 |
| 3,098,726 | A | * | 7/1963 | Stone | 34/596 |
| 3,125,422 | A | * | 3/1964 | Thunander | 34/527 |
| 3,210,862 | A | * | 10/1965 | Lycan | 34/527 |
| 3,255,686 | A | * | 6/1966 | Larson et al. | 454/188 |
| 3,255,688 | A | * | 6/1966 | Iwata | 454/213 |
| 3,439,204 | A | * | 4/1969 | Chambers et al. | 310/58 |
| 3,478,958 | A | * | 11/1969 | Bowen et al. | 417/234 |
| 3,591,095 | A | * | 7/1971 | Di Stefano | 241/41 |
| 4,596,921 | A | * | 6/1986 | Hersh et al. | 392/385 |
| 4,887,641 | A | * | 12/1989 | Alley | 137/601.09 |
| 4,974,339 | A | * | 12/1990 | Kawamura et al. | 34/73 |
| 5,482,507 | A | * | 1/1996 | Priest | 454/359 |
| 5,847,507 | A | * | 12/1998 | Butterworth et al. | 313/512 |
| 6,082,310 | A | * | 7/2000 | Valcic et al. | 122/13.01 |
| 6,321,557 | B1 | * | 11/2001 | Scrivener et al. | 62/296 |
| 6,382,203 | B1 | * | 5/2002 | Kim et al. | 126/110 R |
| 2007/0294909 | A1 | * | 12/2007 | Abdi et al. | 34/97 |
| 2009/0023379 | A1 | * | 1/2009 | Bredahl et al. | 454/267 |

(Continued)

FOREIGN PATENT DOCUMENTS

| | | | | |
|---|---|---|---|---|
| DE | 102007013997 | A1 | | 9/2008 |
| EP | 1813712 | A1 | | 8/2007 |
| JP | 58163460 | A | * | 9/1983 |
| WO | WO 2004043199 | A1 | * | 5/2004 |

*Primary Examiner* — Steve M Gravini

(74) *Attorney, Agent, or Firm* — Nixon & Vanderhye, P.C.

(57) ABSTRACT

A domestic appliance includes an open air duct and a flow cross-section adjuster in the air duct for adjusting a flow cross-section of the air duct. The flow cross-section adjuster includes rotatably mounted blades for noise dampening purpose. The air duct and the flow cross-section adjuster are in a cooling air inflow region relative to a heat exchanger or a compressor of the domestic appliance.

26 Claims, 2 Drawing Sheets

(56) References Cited

U.S. PATENT DOCUMENTS

2009/0151192 A1* 6/2009 Nawrot ..... 34/526
2009/0229141 A1* 9/2009 Nawrot et al. ..... 34/467
2009/0272004 A1* 11/2009 Chernetski et al. ..... 34/389
2010/0155039 A1* 6/2010 Ediger et al. ..... 165/138
2010/0281707 A1* 11/2010 Nawrot et al. ..... 34/134
2010/0293804 A1* 11/2010 Nawrot et al. ..... 34/86
2011/0030238 A1* 2/2011 Nawrot et al. ..... 34/499

* cited by examiner

DOMESTIC APPLIANCE WITH AN OPEN AIR DUCT

BACKGROUND OF THE INVENTION

The invention relates to a domestic appliance with an open air duct. More particularly, the invention relates to a domestic appliances with an air duct which opens toward the surroundings of the domestic appliance and is therefore not closed.

Domestic appliances, for instance tumble dryers, which comprise a housing opening, through which air from outside of the domestic appliance is taken into the interior thereof, are generally known. Input air is conveyed as cooling air through an air duct mounted on a corresponding housing opening to at least one component to be cooled. The disadvantage of such an arrangement in conjunction with noise-generating components such as engines and compressors within the domestic appliance is that noises developing as a result of these components permeate outwards across the ventilation opening between the blades into the area outside of the domestic appliance.

EP 1 813 712 A1 relates to a dryer with a drum for accommodating a product to be treated, a process air duct, in which a heater is located for heating a process air flow and the heated process air flow can be guided to the product by means of a first fan. Here a controllable first throttle for reducing the speed of the process air flow is attached in the process air duct for temperature adjustment purposes. EP 1 813 712 A1 also relates to a method for treating a product in such a dryer, with the first throttle being controlled such that a process air temperature of at least 80° C. is reached. The process air duct and an open cooling air duct can cross in a condenser, with it being possible for cooling air to be taken from the room air into the cooling air duct by means of a second fan and to be guided out after passing through the condenser and with a controllable second throttle for reducing the speed of the cooling air flow being located in the cooling air duct. The second throttle can be arranged between a cooling air inlet and the second fan, between the second fan and the condenser or between the condenser and a cooling air outlet.

DE 10 2007 013 997 A1 relates to a condensation dryer with a drying chamber for objects to be dried, a process air circuit, to which a heater for heating the process air is assigned, with a first fan, with which the heated process air can be guided over the objects to be dried and a heat pump circuit with an evaporator, a compressor and a condenser. A second fan and an air-air heat exchanger which can be passed through by the process air are provided here, by means of which fan a cooling air flow can be generated for the air-air heat exchanger and the compressor. Alternatively, the drying chamber is mounted on at least one roller and a further powering fan which is embodied to cool the compressor is coupled to the roller. DE 10 2007 013 997 A1 also relates to a method for operating a condensation dryer of this type. The opening of the intake tract facing the compressor can be opened and closed for temperature control purposes by way of a controllable flap.

BRIEF SUMMARY OF THE INVENTION

It is an object of an exemplary embodiment of the present invention to provide a domestic appliance, which enables a noise reduction in the surroundings of the domestic appliance.

This object is achieved by means of a domestic appliance as claimed in the independent claim. Preferred embodiments can be inferred in particular from the dependent claims.

A domestic appliance includes an open air duct, with a flow cross-section adjusting facility for adjusting a flow cross-section of the air duct being arranged in the air duct. The air duct can comprise an essentially arbitrary cross-sectional shape which can also change in terms of its course. A passage of sound waves through the flow cross-section adjusting facility is complicated by a cross-section which can be minimized for the cooling so that an interference noise emanating from the domestic appliance can be reduced. There is thus one embodiment such that the flow cross-section can be adjusted to a flow cross-section which can be minimized or is minimal for a predetermined or required cooling power.

The arrangement of the flow cross-section adjusting facility can essentially be provided on any point in the air duct, in other words starting in principle from a configuration of a front-sided element embodying the housing opening to be partially closable and up to a position on the opposite outlet end of the air duct.

The flow cross-section adjusting facility preferably comprises blades, with the blades being rotatably mounted in the air duct for noise damping purposes, in particular at varying angles at right angles to the cross-section of the air duct. A partial or complete closure of such blades enables noise radiating from noise-generating components, such as an engine or compressor, to be clearly reduced by means of the cooling air duct. Compared with other closing elements, the blades enable particularly high noise damping and a low sound level fluctuation.

An arrangement of blades is in principle possible, which are arranged so as to be pivotable about its longitudinal axis or an axis parallel to the longitudinal axis. Particularly preferable is an adjustability of an angularity with blades aligned in parallel to the air flow up to a complete closure of the air duct by the blades positioned at right angles or approximately at right angles thereto. Aside from pivoting the blades by means of blade bearings, a displacement of the blades in suitable sliding guides is also possible for instance.

The air duct and the flow cross-section adjusting facility can be arranged in particular in a cooling air inflow region relative to a component of the housing to be cooled. In particular, a heat exchanger or a compressor are heat-generating and noise-intensive components of a drying device, for instance tumble dryer or washer-dryer, to which cooling air can be fed. A use in a heat pump dryer is particularly preferred.

To ensure an adequate supply of cooling air, the domestic appliance can comprise at least one fan for moving the cooling air relative to the components to be cooled, e.g. the heat exchanger or the compressor, through the air duct. At least one fan can in this case be arranged upstream and/or downstream of the flow cross-section adjusting facility.

For particularly simple realization of a variable adjustment of the flow cross-section, this can be adjustably embodied by means of a flow speed of the air. To this end, blades can be used which can be angled particularly easily and in a defined fashion by means of the cooling air speed.

For a particularly precise and reliable adjustment of the flow cross-section, the flow cross-section adjusting facility can comprise an actuating device for adjusting the flow cross-section, e.g. powered by an electric motor for instance. The electric motor can be connected in particular to a central control facility of the domestic appliance for its actuation.

For further sound dampening, the flow cross-section adjusting facility can comprise at least one component made of a sound-dampening material.

In particular, the blades can comprise a sound-dampening material, e.g. produced from a sound-dampening material or occupied therewith.

The domestic appliance can be configured for instance as a laundry treatment device, like for instance as a tumble dryer, washer-dryer or washing machine. The domestic appliance is however not restricted thereto and can also be configured as a refrigerator for instance.

BRIEF DESCRIPTION OF THE DRAWINGS

In the following Figures, the invention is described schematically in more detail with reference to an exemplary embodiment. The same or functionally-identical elements are provided here with the same reference characters for better clarity.

DETAILED DESCRIPTION OF EXEMPLARY EMBODIMENTS OF THE PRESENT INVENTION

Figure 1:
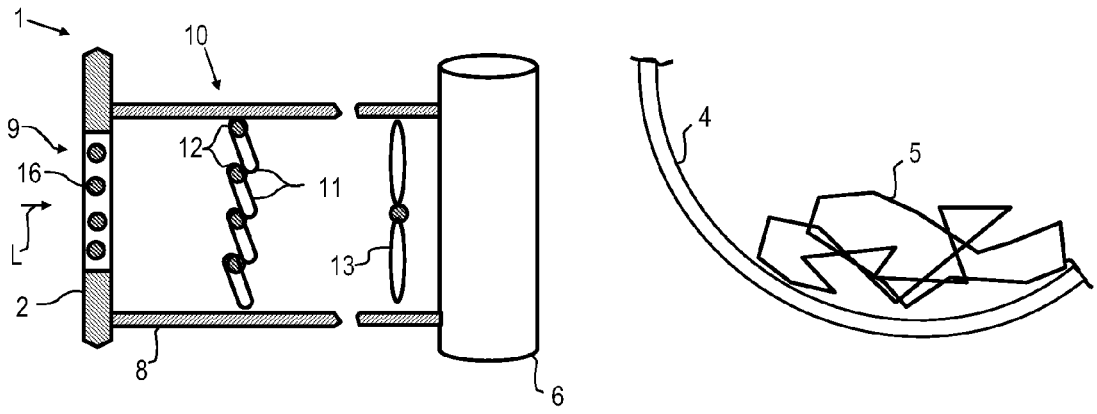
FIG. 1 shows a partial sectional view of exemplary components of a domestic appliance with reference to an exemplary tumble dryer, with blades of a flow cross-section adjusting facility being shown in a closed position.

FIG. 1 shows individual components of a domestic appliance 1. The exemplary domestic appliance 1 is a tumble dryer with a surrounding housing 2, which comprises a drum 4 for receiving laundry 5 to be dried. An air intake opening 9 is embodied in the housing 2, in order to be able to supply cooling air L to a compressor 6 of a heat pump. The air intake opening 9 is provided with a protective grid 16 for aesthetic and safety reasons. An air duct 8 leads from the air intake opening 9 to a compressor 6 to be cooled of a heat pump. To be able to control an intensity of an air flow of the process air L, a fan 13 is provided, which is arranged upstream of the compressor 6 in the air duct 8. With the fan 13, cooling air L is correspondingly taken in from outside through the air intake opening 9. A flow cross-section adjusting facility 10 is arranged in the air duct 8, in order to prevent noises generated by the compressor 6 from escaping outwards. The flow cross-section adjusting facility 10 shown comprises a plurality of parallel blades 11. The blades 11 are pivotably arranged in the air duct 8 across blade bearings 12 about their longitudinal axis or an axis parallel to its longitudinal axis. An extension of the blades 11 is selected here such that, in a closed state shown in FIG. 1, these preferably close the entire flow cross-section of the air duct 8. In this state, the blades 11 form a barrier or noise wall for noises, which otherwise permeate from the interior of the domestic appliance 1 through the air duct 8. The blades 11 preferably comprise a noise-dampening material.

Figure 2:
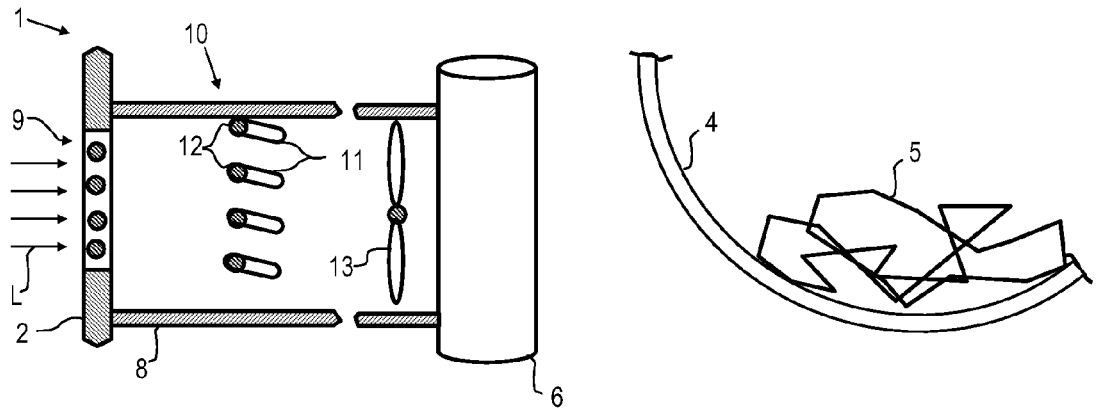
FIG. 2 shows the components according to FIG. 1, with the blades of the flow cross-section adjusting facility being shown in an opened position.

Compared with FIG. 1, FIG. 2 shows a mode of operation of the blades 11, in which the cooling air L is taken in through the air duct 8 with a strong air flow. To enable this, the blades 11 are pivoted about the blade bearing 12. Depending on the intensity of the air flow of the process L, the adjusting angle of the blades 11 according FIG. 2 can preferably be variably adjusted between a completely closed position of the blades 11 according to FIG. 1 and a position of the blades 11 which is parallel or approximately parallel relative to the air flow direction. Parallel is understood here to mean that the blades with their longitudinal extension and planar extension are aligned in parallel to the strong air flow or in parallel to the walls of the air duct 8.

In the embodiment according to FIG. 1 and FIG. 2, the blades 11 are mounted by means of the blade bearing 12 and are embodied from a light-weight material such that the blades 11 are adjusted into a necessary adjusting position by means of the speed of the air flow of the process air L alone in order to achieve an adequate air flow. The force for adjusting the blades 11 thus originates indirectly from the fan 13, which opens increasingly automatically with an increasingly strong intake effect and as a result increased air flow. The fan 13 is arranged downstream in respect of the blades 11, the blades 11 are in other words disposed in an intake region of the fan 13. This self-adjusting arrangement can be implemented in a particularly simple and cost-effective fashion.

Figure 3:
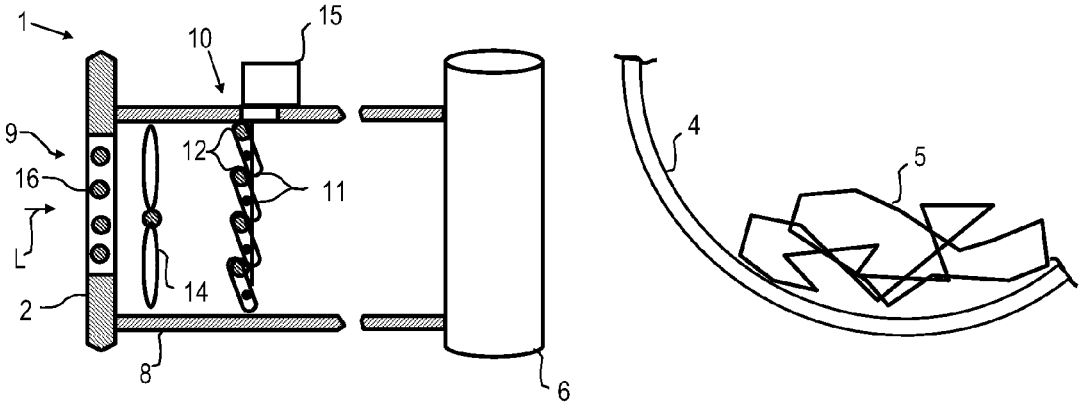
FIG. 3 shows an alternative embodiment of a domestic appliance of this type with closed blades and FIG. 4 shows the embodiment according to FIG. 3 with opened blades.
Figure 4:
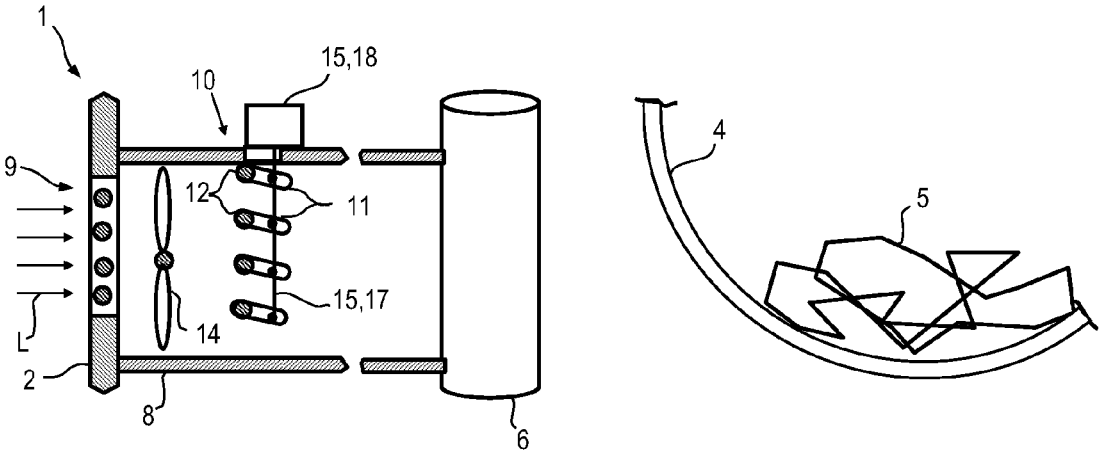

FIG. 3 and FIG. 4 show an exemplary alternative configuration, in which the individual components which differ in respect of FIGS. 1 and 2 can also be implemented in a combined fashion in other configurations in full or in part.

FIG. 3 also shows a closed or approximately closed state of the blades 11, while FIG. 4 again shows an opened or approximately opened state of the blade 11.

For opening and/or closing or partially closing the blades 11, an actuating device 15 is now used, which adjusts the individual blades 11 by means of mechanical means, e.g. a lifting rod 17. The mechanical means 17 can be controlled here directly by a central control facility of the domestic appliance 1 by way of an electric motor or electromagnetic drive 18. A mechanical coupling to other components such as a drive of the compressor 6 is in principle also possible in order to be able to control the variable position of the blades 11 directly as a function of a controller of the compressor 6 by way of mechanical adjusting elements. A second fan 14 is used to generate the air flow of the cooling air L, said fan being arranged in the air duct 8 between the air intake opening 9 and the blades 11 of the flow cross-section adjusting facility 10. The fan 13 is arranged upstream in respect of the blades 11, said blades 11 in other words being disposed in an exit region of the fan 13.

The present invention is naturally not restricted to the exemplary embodiment shown.

The air duct fan 14 according to FIG. 3 can additionally be arranged relative to a fan 13 of a compressor 6 according to FIG. 1. An actuating device according to FIG. 3 can also be arranged in an embodiment according to FIG. 1.

In the exemplary embodiment shown, the arrangement of the blades 11 and/or adjusting elements of the flow cross-section adjusting facility is provided centrally in the air duct 8. The blades 11 or other suitable closing elements can however also be arranged on another position of the air duct. An arrangement is in principle even possible on the exterior ends of the air duct 8, with the blades 11 finally even being used instead of a protective grid of the housing opening. In this sense, the air duct can even be reduced to a degree which corresponds to a frame for accommodating blades of this type.

An embodiment can also be provided, which manages without a fan for generating an air flow to the compressor. The invention is also not restricted to a compressor as the component to be cooling.

What is claimed:

1. A domestic appliance comprising: an open air duct; and a flow cross-section adjuster in the air duct configured to adjust a flow cross-section of the air duct, the flow cross-section adjuster comprising rotatably mounted blades to dampen noise, wherein the air duct and the flow cross-section adjuster are in a cooling air inflow region relative to a noise- and heat-generating device of the domestic appliance, wherein in a closed state said rotatably mounted blades are positioned close the flow cross-section.

2. The domestic appliance of claim 1, further comprising a fan to move cooling air to the noise- and heat-generating device through the air duct.

3. The domestic appliance of claim 2, wherein said fan is located upstream of the flow cross-section adjuster.

4. The domestic appliance of claim 2, wherein said fan is located downstream of the flow cross-section adjuster.

5. The domestic appliance of claim 1, wherein a flow cross-section of the flow cross-section adjuster is adjustable in response to a flow speed of the air.

6. The domestic appliance of claim 1, wherein the flow cross-section adjuster has an actuating device to adjust the flow cross-section to dampen noise.

7. The domestic appliance of claim 1, wherein the flow cross-section adjuster is adjustable to minimize the flow cross-section for a predetermined cooling power.

8. The domestic appliance of claim 1, wherein the flow cross-section adjuster comprises a sound-dampening material.

9. The domestic appliance of claim 1, wherein the blades comprise a sound-dampening material.

10. The domestic appliance of claim 1, configured as a tumble dryer, washer-dryer or washing machine.

11. The domestic appliance of claim 10, further comprising a heat pump and wherein the flow cross-section adjuster is an open air duct toward or away from the heat pump.

12. A domestic appliance comprising:

a chamber to receive domestic items to be treated;

a noise- and heat-generating device included in a treatment process of the domestic appliance;

a heat exchanger or a compressor adjacent the chamber;

an air duct; and a flow cross-section adjuster in or adjacent the air duct, the flow cross-section adjuster comprising at least one rotatably mounted blade to dampen noise, wherein the air duct and the flow cross-section adjuster are positioned in a cooling air inflow region relative to the noise- and heat-generating device, and wherein in a closed state said at least one rotatably mounted blade is positioned to close the flow cross-section to dampen noise and in an open state said at least one rotatably mounted blade is positioned to allow cooling air into the air duct to cool the noise- and heat-generating device.

13. The domestic appliance of claim 12, further comprising a fan to move the cooling air inflow to the noise- and heat-generating device through the air duct.

14. The domestic appliance of claim 13, wherein said fan is located arranged upstream of the flow cross-section adjuster.

15. The domestic appliance of claim 13, wherein said fan is located downstream of the flow cross-section adjuster.

16. The domestic appliance of claim 12, wherein a flow cross-section of the flow cross-section adjuster is adjustable in response to a flow speed of the air.

17. The domestic appliance of claim 12, wherein the flow cross-section adjuster has an actuating device to adjust the flow cross-section to dampen noise.

18. The domestic appliance of claim 12, wherein the flow cross-section adjuster is adjustable to minimize the flow cross-section for a predetermined cooling power.

19. The domestic appliance of claim 12, wherein the flow cross-section adjuster comprises a sound-dampening material.

20. The domestic appliance of claim 12, wherein the at least one rotatably mounted blade comprises a sound-dampening material.

21. The domestic appliance of claim 12, further comprising a tumble dryer, washer-dryer or washing machine.

22. The domestic appliance of claim 1, wherein said noise- and heat-generating device comprises a heat exchanger and/or a compressor.

23. The domestic appliance of claim 12, wherein said noise- and heat-generating device comprises a heat exchanger and/or a compressor.

24. The domestic appliance of claim 1, further comprising a tumble dryer, washer-dryer or washing machine.

25. The domestic appliance of claim 1, wherein said cooling air inflow enters the air duct from outside of the domestic appliance.

26. The domestic appliance of claim 12, wherein said cooling air inflow enters the air duct from outside of the domestic appliance.

* * * * *

UNITED STATES PATENT AND TRADEMARK OFFICE

CERTIFICATE OF CORRECTION

PATENT NO. : 8,667,702 B2
APPLICATION NO. : 12/627038
DATED : March 11, 2014
INVENTOR(S) : Rainer Ediger, Thomas Nawrot and Werner Nühse It is certified that error appears in the above-identified patent and that said Letters Patent is hereby corrected as shown below:

In the Claims

Column 5, line 2 (claim 1, line 10) should read:

are positioned --to-- close the flow cross-section.

Column 6, line 8 (claim 14, line 2) should read:

located [[arranged]] upstream of the flow cross-section adjuster.

Signed and Sealed this
Twenty-fourth Day of June, 2014

Michelle K. Lee

Michelle K. Lee
*Deputy Director of the United States Patent and Trademark Office*